US005929843A

United States Patent [19]

Tanioka

[11] Patent Number: 5,929,843

[45] **Date of Patent: *Jul. 27, 1999**

[54] IMAGE PROCESSING APPARATUS WHICH EXTRACTS WHITE COMPONENT DATA

[75] Inventor: Hiroshi Tanioka, Yokohama, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/774,004

[22] Filed: Dec. 26, 1996

Related U.S. Application Data

[63] Continuation of application No. 08/499,738, Jul. 7, 1995, abandoned, which is a continuation of application No. 07/968,402, Oct. 29, 1992, abandoned.

[30] Foreign Application Priority Data

Nov. 7, 1991 [JP] Japan ..... 3-291453

[51] Int. Cl.[6] ..... G09G 5/02

[52] U.S. Cl. ..... 345/150; 348/690

[58] Field of Search ..... 345/150, 152–155, 345/89, 147; 348/690

[56] References Cited

U.S. PATENT DOCUMENTS

| | | | |
|---|---|---|---|
| 2,183,525 | 12/1939 | Yule | 358/79 X |
| 2,947,805 | 8/1960 | Moe et al. | 358/79 |
| 2,949,499 | 8/1960 | Zeyen et al. | 358/79 |
| 3,725,569 | 4/1973 | Ashworth et al. | 358/79 |
| 4,367,924 | 1/1983 | Clark et al. | 350/334 |
| 4,513,281 | 4/1985 | Ngo | 340/703 |
| 4,958,218 | 9/1990 | Katayama et al. | 358/75 |
| 5,059,963 | 10/1991 | Fukuoka | 340/703 X |
| 5,119,086 | 6/1992 | Nishioka et al. | 345/147 |
| 5,189,406 | 2/1993 | Humpries et al. | 345/147 |
| 5,309,170 | 5/1994 | Takashi et al. | 345/89 |
| 5,512,948 | 4/1996 | Iwamatsu | 348/690 |

FOREIGN PATENT DOCUMENTS

| | | | |
|---|---|---|---|
| 0330361 | 8/1989 | European Pat. Off. | G09G 1/28 |
| 2534052 | 4/1984 | France | G09G 3/36 |
| 2130781 | 6/1984 | United Kingdom | G09G 3/36 |

OTHER PUBLICATIONS

*IEEE Transactions on Communications*, vol. Com–29, No. 12, Dec. 1981 pp. 1898–1925.

*Le Journal de Physique Letters*, vol. 36, 1975, pp. L–69.

*Applied Physics Letters*, vol. 36, No. 11, 1980, pp. 899–901.

"Method For Mapping Medium Resolution Graphic of Four Colors on a Two–Color Liquid Crystal Display," IBM Technical Disclosure Bulletin, vol. 29, No. 2, Jul. 1986, pp. 798–799.

*Primary Examiner*—Amare Mengistu

*Attorney, Agent, or Firm*—Fitzpatrick, Cella, Harper & Scinto

[57] ABSTRACT

A method and apparatus for processing image data comprising the steps of extracting white component data from input R, G, B color data, suppressing the white component data in accordance with a non-linear characteristic, generating R, G, B, W display data and driving a liquid crystal display panel having R, G, B, W filters in accordance with the R, G, B, W display data in order to display a full color image.

17 Claims, 10 Drawing Sheets

FIG.3

| R | G | B | W | |
|---|---|---|---|---|
| 0 | 0 | 0 | 0 | BLACK |
| 0 | 0 | 0 | 1 | DARK GREY |
| 0 | 0 | 1 | 0 | BLUE |
| 0 | 0 | 1 | 1 | LIGHT BLUE |
| 0 | 1 | 0 | 0 | GREEN |
| 0 | 1 | 0 | 1 | LIGHT GREEN |
| 0 | 1 | 1 | 0 | CYAN |
| 0 | 1 | 1 | 1 | LIGHT CYAN |
| 1 | 0 | 0 | 0 | RED |
| 1 | 0 | 0 | 1 | LIGHT RED |
| 1 | 0 | 1 | 0 | MAGENTA |
| 1 | 0 | 1 | 1 | LIGHT MAGENTA |
| 1 | 1 | 0 | 0 | YELLOW |
| 1 | 1 | 0 | 1 | LIGHT YELLOW |
| 1 | 1 | 1 | 0 | LIGHT GREY |
| 1 | 1 | 1 | 1 | WHITE |

IMAGE PROCESSING APPARATUS WHICH EXTRACTS WHITE COMPONENT DATA

This application is a continuation of application Ser. No. 08/499,738 filed Jul. 7, 1995, which is a continuation of application Ser. No. 07/968,402 filed Oct. 29, 1992, both now abandoned.

BACKGROUND OF THE INVENTION

This invention relates to an image processing apparatus which processes data for a color image for display by a display device, such as a liquid crystal display.

Such liquid crystal displays are as display devices in personal computers, word processors or televisions and the like.

The use of a bistable liquid crystal element has been proposed by Clark and Lagerwall (U.S. Pat. No. 4,367,924). Ferroelectric liquid crystal having Chiral smectic C phase (Sm C *) or H phase (Sm H *) is usually used as the bistable liquid crystal. This liquid crystal has bistable states in the absence of an electric field, including a first optically stable state (first orientation state) and a second optically stable state (second orientation state). Accordingly, unlike an optical modulation element used in a TN (twist nematic) type liquid crystal, the liquid crystal is oriented stably in the first optically stable state by one electric field vector, and the liquid crystal is oriented stably in the second optically stable state by the other electric field vector.

The liquid crystal of this type quickly responds to the applied electric field to assume one of the two stable states and maintains the state when the electric field is removed.

However, the bistable liquid crystal element has only two states, so a liquid crystal display which consists of such bistable liquid crystal cells cannot display a halftone image or a full color image.

SUMMARY OF THE INVENTION

The present invention has been made in view of the above problems in order is to provide an image processing apparatus and method which can display a color image with rich colors.

The present invention also provides an image processing apparatus and method which can display a full color image using a display device, of which each display element displays an image with at least two levels.

The present invention also provides an image processing apparatus and method which can display a color image having low brightness without the deterioration of image quality.

According to a first aspect of the present invention, there is provided an image processing apparatus, comprising extraction means for extracting white component data from color data representing a color image; generating means for generating color display data on the basis of the color data and the white component data, the color display data including white display data; and display means for displaying a color image in accordance with the color display data, the display means displaying white pixels in accordance with the white display data.

According to a second aspect of the present invention, there is provided an image processing apparatus comprising extracting means for extracting white component data from colour data representing a colour image; suppressing means for suppressing the white component data; generating means for generating color display data on the basis of the color data and the suppressed white component data; and display means for displaying a color image in accordance with the color display data.

According to a third aspect of the present invention, there is provided an image processing apparatus, comprising: input means for inputting multi-level color data representing a color image; pseudo halftone processing means for performing on the multi-level color data a pseudo halftone process to express a halftone image by controlling the rate of pixels in a unit area, and display means for displaying a color image in accordance with the color data subjected to the pseudo halftone process.

According to a fourth aspect of the present invention, there is provided an image processing apparatus, comprising: input means for inputting color data representing a color image; processing means for processing the color data to produce color display data; and display means for displaying a color image on the basis of the color display data; characterised in that the display means displays the color image using a plurality of two level pixels, and that the processing means produces the color display data which expresses halftone images using the plurality of two level pixels.

According to further aspects of the present invention, there are provided methods of image processing which using the apparatus of the above first, second, third and fourth aspects of the present invention.

The aforesaid objectives and effects and other of the present invention are evident from the following examples of preferred embodiments in accordance with the invention.

BRIEF DESCRIPTION OF THE DRAWINGS

FIG. 3 to shows sixteen colors which can be displayed by a basic unit in accordance with an embodiment of the invention;

DESCRIPTION OF THE PREFERRED EMBODIMENT

Figure 1:
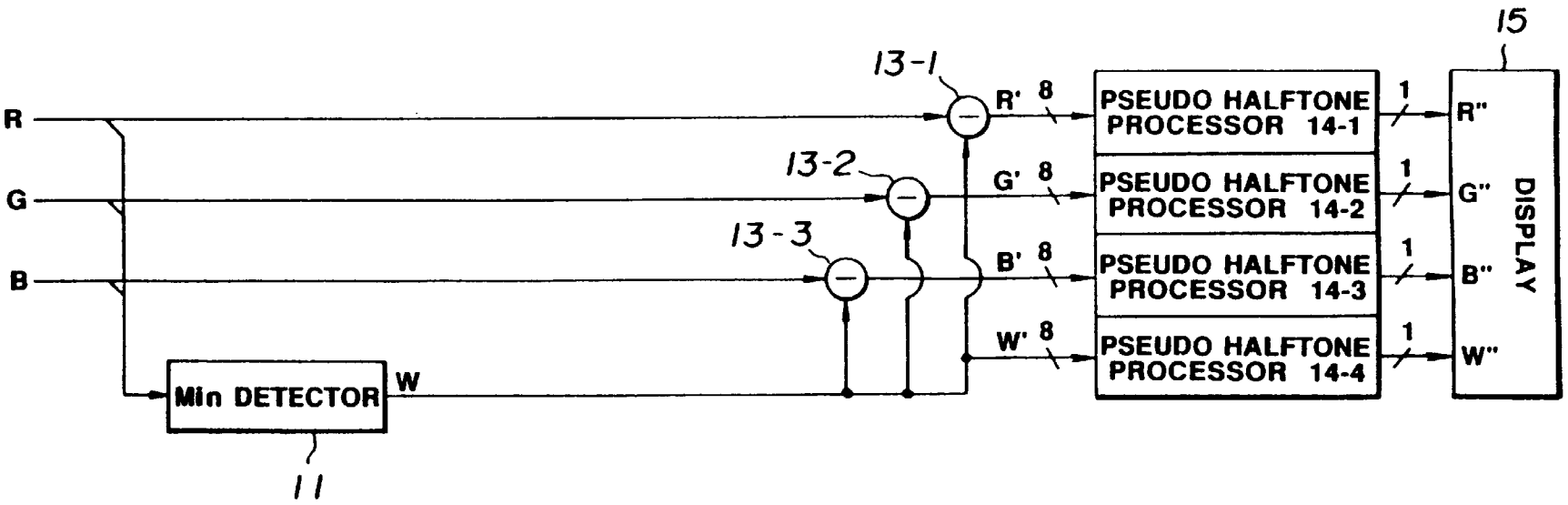
FIG. 1 is a block diagram of an image processing apparatus in accordance with an embodiment of the present invention.

FIG. 1 shows a block diagram of an image processing apparatus embodying the present invention. The image processing apparatus comprises a minimum value detector 11, subtractors 13-1–13-3, pseudo halftone processors 14-1–14-4 and a display 15. Red (R), Green (G) and Blue (B) colour data representing a color image are inputted from an external device, such as a host computer, pixel by pixel.

The display 15 has a liquid crystal display panel which is composed of ferroelectric liquid crystal. On the liquid crystal display panel, 640×560 liquid crystal cells, each of which can assume two states, are arranged in a matrix.

Figure 2:
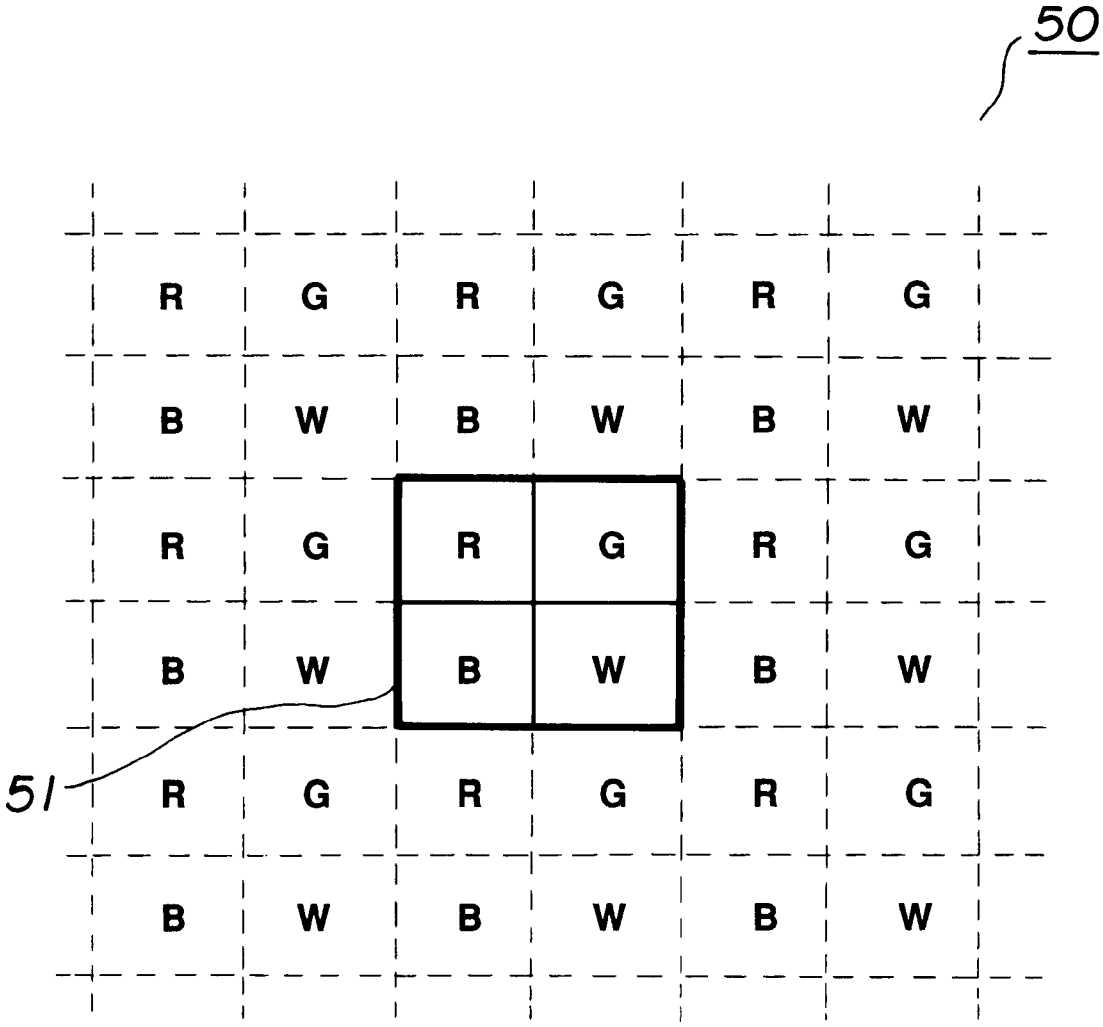
FIG. 2 illustrates of a liquid crystal display panel.

FIG. 2 shows a part of the liquid crystal display panel 50. A single basic unit 51 forms a pixel and consists of four liquid crystal cells, each state of which can be controlled independently. Namely, the four liquid crystal cells can transmit or shut off the light from the back of the liquid crystal display panel 50, respectively.

Four color filters, red (R), green (G), blue (B) and white (W) filters, are provided respectively on the four liquid crystal cells in the basic unit 51. Therefore, the basic unit 51 can display sixteen colors shown in FIG. 3 by controlling the states of the four liquid crystal cells independently.

In FIG. 3, "1" represents a transparent state and "0" represents an opaque state. Thus, the liquid crystal display panel 50 is provided with not only R,G,B filters but also W filters. Accordingly, it can display eight additional colors, such as dark grey, light blue and so on, which cannot be displayed by using only R,G,B filters.

On the liquid crystal display panel 50, twenty sets of basic unit 51 are arranged in one square millimeter. A color displayed by such a small basic unit 51 is not recognized by the naked eye. However mixtures of colors of several neighbouring pixels (basic units) can be recognized.

Accordingly, if a pseudo halftone process, which expresses a halftone image by controlling the rate of pixels to be displayed in a unit area, is performed on R,G,B color data, a full color image can be displayed by the liquid crystal display panel 50, of which each liquid crystal cell displays binary image and each basic unit displays sixteen colors.

The minimum value detector 11 detects a minimum value among the 8-bit R,G,B colour data supplied pixel by pixel from a host computer via a data bus. The minimum value detected by the minimum value detector 11 is treated as W data which represents the white component.

The process of extracting the W data from the R,G,B color data will be described with reference to FIG. 4.

Figure 4:
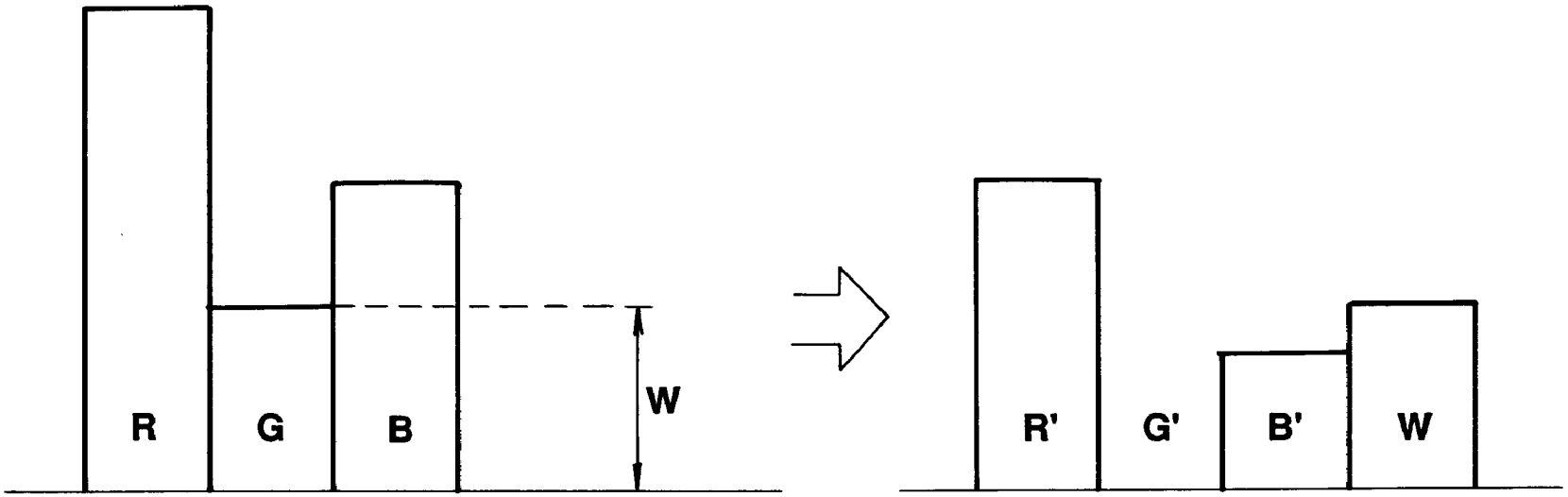
FIG. 4 is a drawing to shows the process of extracting W data.

In FIG. 4, when all the R,G,B color data is 255 i.e. 8-bits, a white image is represented by the R,G,B color data. Therefore, a minimum value among the R,G,B color data Min (R,G,B) corresponds to a white component value.

Accordingly, if the Min (R,G,B) is assumed to be W data then the, R',G',B' data (which are used for driving the liquid crystal display panel 50), can be formed by removing the W component from the R,G,B components, respectively, as expressed by equations (1).

$$\left.\begin{aligned} W &= \mathrm{Min}(R, G, B) \\ R' &= R - W \\ G' &= G - W \\ B' &= B - W \end{aligned}\right] \quad (1)$$

The subtractors, 13-1–13-3, subtract the W data, which were obtained by the minimum value detector 11, from the R,G,B color data, respectively, so as to generate the R',G',B' data expressed in equations (1).

The R',G',B' data are multi-value data, so they cannot be directly drive liquid crystal display panel 50, where liquid crystal cells assume two states.

Therefore, the pseudo halftone processors 14-1–14-4 perform the pseudo halftone processes on the R',G',B',W data, respectively. This converts the R',G',B',W data into binary driving data, i.e. R",G",B",W" data which correspond to the liquid crystal cells provided with the R,G,B,W filters.

The pseudo halftone processors 14-1–14-4 may perform the pseudo halftone process, which expresses a halftone image by controlling the rate of pixels to be displayed in a unit area, in accordance with an error diffusion method, an ordered dither process and so on. Details of such methods are disclosed in U.S. Pat. No. 4,958,218 and IEEE Transactions on Communications, Vol. Com-29, No.12, December 1981, pages 1898–1925 which are incorporated herein by reference.

Figure 5:
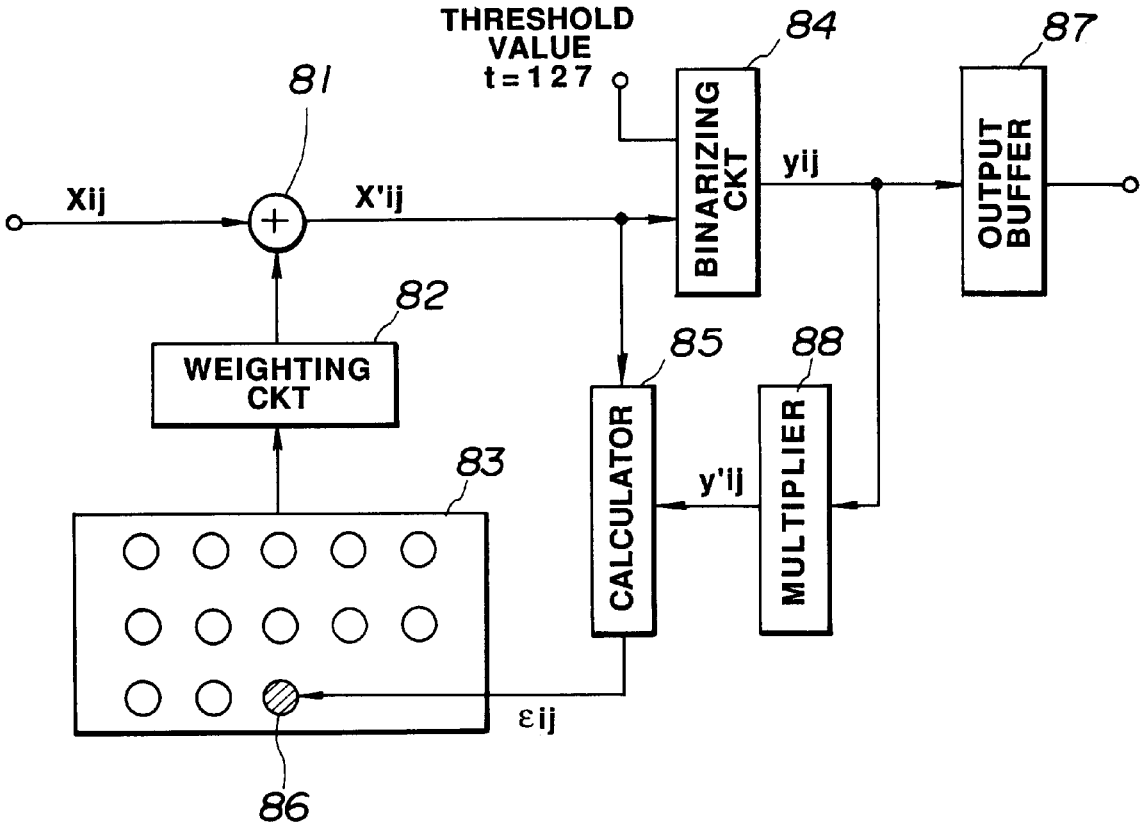
FIG. 5 is a block diagram of a pseudo halftone processor.

FIG. 5 is a block diagram of the pseudo halftone processor 14-1. In FIG. 5 the R' data is processed in accordance with the error diffusion method. The R' data is represented as image data Xij.

In the error diffusion method, image data Xij is added by an adder 81 to a value which is obtained by multiplying a weight coefficient $\alpha ij$ designated by a weighting circuit 82 to an error $\epsilon ij$ (the difference between correction data X'ij which has previously been generated and output data Yij) stored in an error buffer memory 83. The adding process can be expressed by the following equation:

$$X'ij = Xij + \left(\sum_{kl} \alpha kl \epsilon i+k,\ i+l\right) \Big/ \sum_{kl} \alpha kl$$

Figure 6:
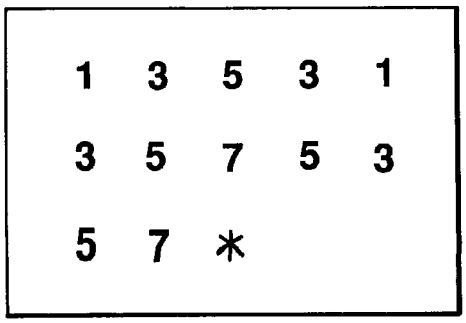
FIG. 6 is a drawing to shows an example of weight coefficients.

FIG. 6 shows an example of weight coefficients. In FIG. 6, * indicates a position of a pixel which is at present being processed.

Next, the correction data X'ij is compared with the threshold value T (in this case, D max=255, T=127) by a binarizing circuit 84, so that data Yij is output. Yij is the data which was binarised into 1s or 0s. The binarizing data is stored into an output buffer 87 and supplied to the display 15.

On the other hand, the difference $\epsilon ij$ between the correction data X'ij and the data Y'ij, which is obtained by multiplying the data Yij output from the binarising circuit 84 by 255, is calculated by a calculator 85. The result from the calculator 85 is stored into an area at a position corresponding to a pixel position 86 in the error buffer memory 83.

By repeating those operations, the binarization due to the error diffusion method is executed.

The pseudo halftone processors 14-2–14-4 can be realized by the same construction as that of the pseudo halftone processor 14-1 shown in FIG. 5.

The R",G",B",W" binary data obtained by the binarizing process of the pseudo halftone processors 14-1–14-4 are supplied to the display 15.

Figure 7:
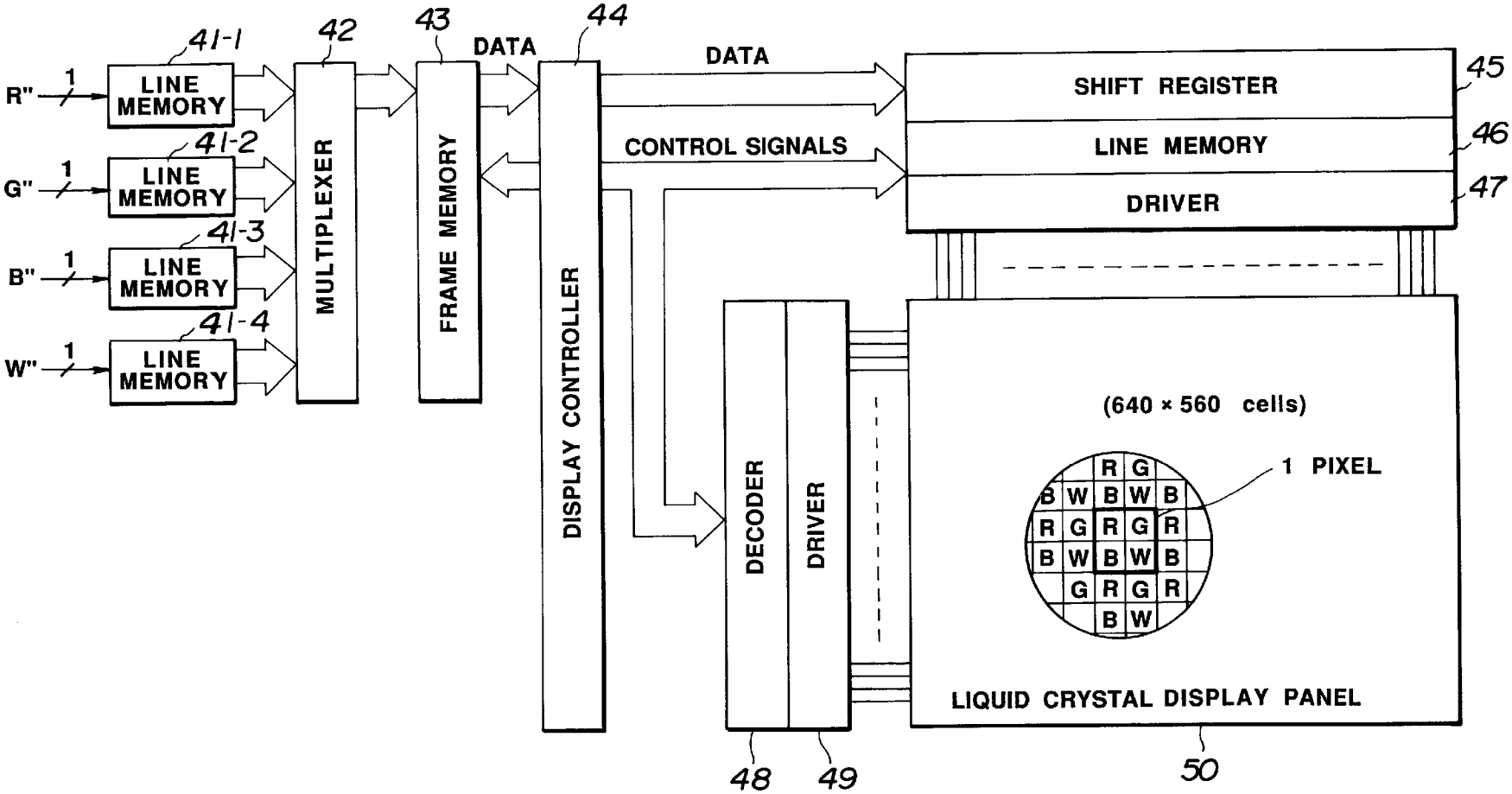
FIG. 7 is a block diagram of a display.

FIG. 7 shows the construction of the display 15. Line memories 41-1–41-4 store the R",G",B",W" binary data obtained by the pseudo halftone process. A multiplexer 42 rearranges the R",G",B",W" binary data pixel by pixel, so as to arrange them in a data arrangement corresponding to that of the R,G,B,W filters shown in FIG. 2. A frame memory 43 stores a frame of the R",G",B",W" binary data subjected to the rearrangement by the multiplexer 42.

A display controller 44 reads out the R",G",B",W" binary data from the frame memory 43, line by line, and supplies them to a shift register 45 in a serial manner.

The display controller 44 also supplies control signals to a line memory 46, a driver 47 and a decoder 48.

The shift register 45 supplies a line of the R",G",B",W" binary data to the line memory 46 in parallel manner. The line memory 46 supplies the R",G",B",W" binary data to the driver 47 as binary signals indicating ON/OFF states of a line of the liquid crystal cells. The driver 47 drives each of the liquid crystal cells of the liquid crystal display panel 50 in response to the R",G",B",W" binary data from the line memory 46.

The decoder 48 indicates a line to be driven. A driver 49 sequentially drives the liquid crystal cells of the liquid crystal display panel 50, line by line.

According to the above construction, each of 640×560 liquid crystal cells on the liquid crystal display panel 50 assumes either the transparent state or the opaque state in response to the R",G",B",W" data. Thereby, a full color image represented by the R,G,B color data is displayed on the liquid crystal display panel 50.

As explained above, the white component is extracted from the input R,G,B color data, and full color image display data, i.e. Red, Green, Blue and White display data, are formed on the basis of the extracted white component. Then a full color image is displayed by the liquid crystal display panel, on which white filters are provided in addition to red, green and, blue filters, in accordance with the Red, Green, Blue and White display data.

According to this embodiment, a full color image can be displayed with rich colors by using the liquid crystal display panel where, each liquid crystal cell of displays binary image.

In addition to, the pseudo halftone process, an error diffusion method or an ordered dither process may be performed on the multi-level data representing a color image, so as to obtain binary color image data.

According to this embodiment, a full color image can be displayed by using the liquid crystal display panel where, each liquid crystal cell assumes two states.

The combination of the pseudo halftone process and the display may be used without the white filters.

The liquid crystal display panel 50 will now be described in detail.

Chiral smectic liquid crystal having ferroelectric properties is particularly suitable as a liquid crystal material used for the liquid crystal display panel 50. Specifically, chiral smectic C phase (SmC*), chiral smectic G phase (Sm G*), chiral smectic F phase (Sm F*), chiral smectic I phase (Sm I*) or chiral smectic H phase (Sm H*) liquid crystal may be used. Details of the ferroelectric liquid crystal are described in "Ferroelectric Liquid Crystals" Le Journal de Physique Letters 1975, No. 36 (L-69), "Submicro Second Bistable Electro-optic Switching in Liquid Crystals" Applied Physics Letters, 1980, No. 36 (11), and "Liquid Crystals" Solid-State Physics of Japan, 1981, No. 16 (141).

Specific examples of the ferroelectric liquid crystal compound are decyloxybenzylidene -p'-amino-2-methylbutylcinnamate (DABAMBC), hexyloxybenzylidene-p'-amino-2-chloropropyl cinnamate (HOBACPC), and 4-0-(2-methyl)-butylresorcylidene-4'-octylaniline (MBRA 8).

The ferroelectric liquid crystal which exhibits cholesteric phase at a temperature higher than that of chiral smectic phase liquid crystal is preferred one example is, biphenylester liquid crystal which exhibits a phase transistion temperature.

When the element is constructed by using one of those materials, the element may be supported by a copper block having a heater embedded therein in order to keep the element at a temperature at which the liquid crystal compound exhibits a desired phase.

Figure 8:
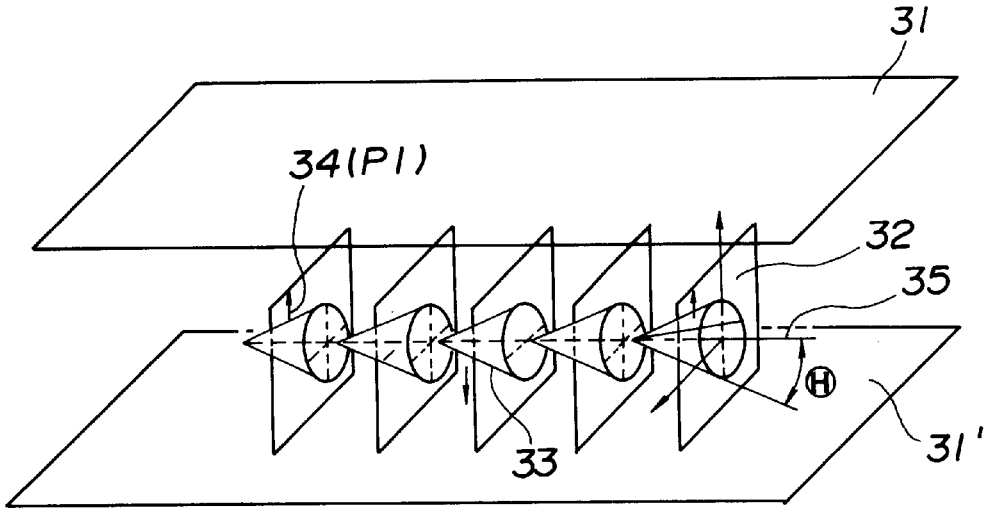
FIG. 8 is a drawing to shows the operation of a ferroelectric liquid crystal.

FIG. 8 shows a cell to explain the operation of the ferroelectric liquid crystal. The Sm C* phase is assumed as the desired phase.

Numerals 31 and 31' denote substrates (glass plates) covered by transparent electrodes made of thin films such as $In_2O_3$, $SnO_2$ or ITO (indium-tin oxide), Sm C* phase liquid crystal, which is oriented such that a liquid crystal molecule layer 32 is normal to the substrates is filled between the substrates. Thick lines 33 represent the liquid crystal molecules which form a continuous spiral structure in parallel with the substrate plane. An angle between a center axis 35 of the spiral structure and an axis of the liquid crystal molecules 33 is represented by H. The liquid crystal molecules 33 each has a bipolar moment (P⊥) 34 orthogonally to the molecule.

When a voltage higher than a predetermined threshold is applied between the substrates 31 and 31', the spiral structure of the liquid crystal molecules 33 is released and the liquid crystal molecules 33 may be reoriented so that all the bipolar moments (P⊥) 34 are oriented along the electric field. The liquid crystal molecule 33 is of elongated shape and a refractive index along a major axis and a refractive index along a minor axis are different. Thus, when polarisers which are cross-nicol to each other are placed on the opposite sides of the glass plate, a liquid crystal optical element, whose optical characteristics change depending on a polarity of applied voltage, is provided.

Figure 9:
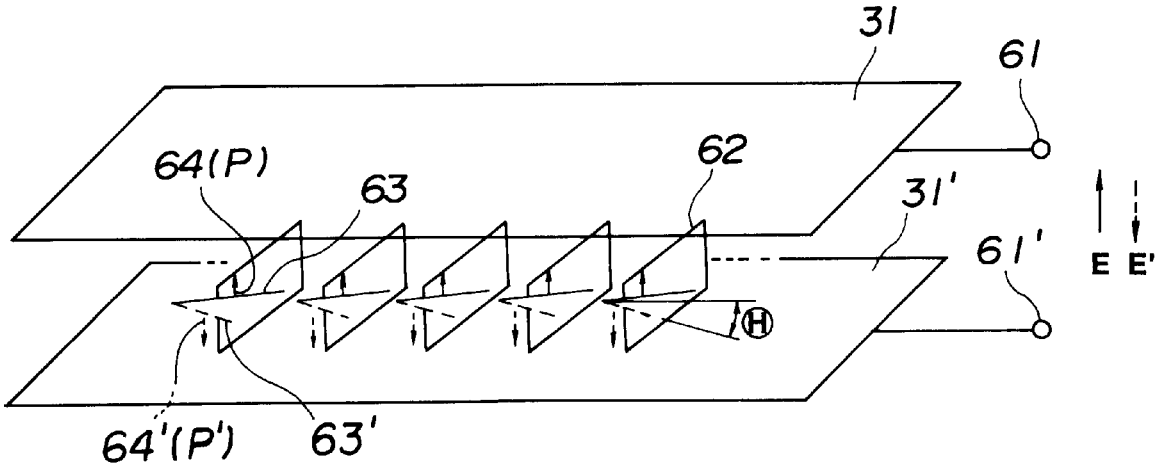
FIG. 9 is a drawing to shows the states of a ferroelectric liquid crystal.

The above mentioned liquid crystal cell may be very thin (for example, 10 μm or less). As the liquid crystal layer is thinned, the spiral structure of the liquid crystal molecules is released even when the electric field is not active as shown in FIG. 9. The bipolar moment P or P' is then oriented either upward (64) or downward (64'). One half of an angle between the molecule axis of the liquid crystal molecule 63 and a direction 63' is called a tilt angle (H) which is equal to one half of an apex angle of a cone of the spiral structure.

Electric fields E or E' of different polarity, which are higher than a predetermined threshold, are applied to such a cell by voltage application means 61 or 61' as shown in FIG. 9. Thus, the bipolar moment is reoriented upward 64 or downward 64' in accordance with the electric field vector of the electric field E or E', and the liquid crystal molecules are oriented in either the first stable state 63 or the second stable state 63'.

There are two advantages in utilizing the ferroelectric liquid-crystal optical element, as described above.

First, the response speed is very fast secondly, the orientation of the liquid crystal molecule is bistable. The second advantage is explained with reference to FIG. 9.

When the electric field E is applied, the liquid crystal molecule is oriented in the first stable state 63 which is stable even after the electric field is removed. When the electric field E' of the opposite polarity is applied, the liquid crystal molecule is oriented in the second stable state 63' which is also stable even after the electric field is removed.

The cell is preferably as thin as possible in order to effectively attain the fast response speed and the bistability.

As explained above, according to the construction as shown in FIG. 1, a colour image is displayed by using the liquid crystal display panel 50, on which white filters are provided in addition to red, green, and blue filters. Accordingly, it is possible to display a full color image with rich colours.

However, when pixels having high brightness, such as white pixels, are sparsely dotted within dozens of pixels representing the same color, such pixels are prominent as differential granules and lower the quality of the displayed image.

For example, colors of low brightness, such as dark grey, dark red, dark green or dark blue, etc., contain a lesser white color component. So the liquid crystal cells provided with white filters are sparsely activated. Consequently, white pixels sparsely dot the displayed image and the quality of the displayed image may lower.

However, the white component can be expressed by the combination of liquid crystal cells of low brightness which are provided with R,G,B filters, instead of liquid crystal cells of high brightness which are provided with W filters.

Accordingly, when low brightness colors are to be displayed, such as dark grey or dark red etc., in which white pixels are sparsely activated according the process expressed by equations (1) such colors is performed, is displayed, such colour are better displayed by the combination of liquid crystal cells having with R,G,B filters, and not using liquid crystal cells having W filters. Thereby, white pixels do not dot the displayed image deterioration of image quality can be prevented.

Alternatively, it is not necessary to prevent occurrence of white pixels when, when the colour of high-brightness colors are to be displayed, because the quality is not diminished by the process expressed in equations (1). Accordingly, the colour of high brightness colors should be displayed by using liquid crystal cells having not only R,G,B filters but also W filters. Thus, a full color image can be displayed with rich colors.

In view of these circumstance, W data, which is represented by the minimum value among the R,G,B color data, is converted in accordance with a predetermined conversion characteristic. This conversion characteristic suppresses the white component at the range where the amount of white component is relatively low. Then, the white component which is suppressed by this conversion is compensated by increasing the amount of R,G,B components.

The process for generating R',G',B',W' data from the R,G,B color data by using a non-linear characteristic will now be explained with reference to FIG. 10.

Figure 10A:
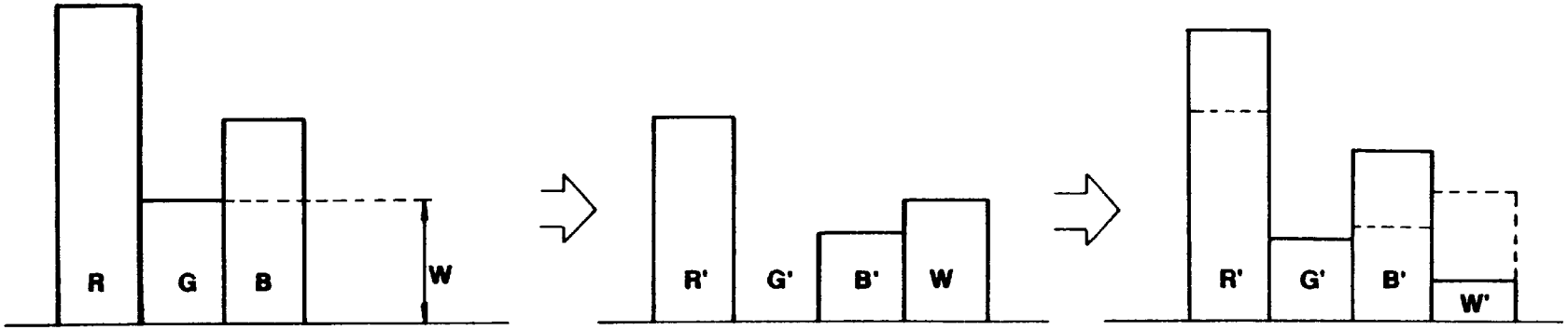
FIGS. 10A, B and C illustrate the process of generating R', G', B'and ,W' data.

In FIG. 10(A), a minimum value among the R,G,B color data (Min (R,G,B)) corresponds to a white component value.

Figure 10B:
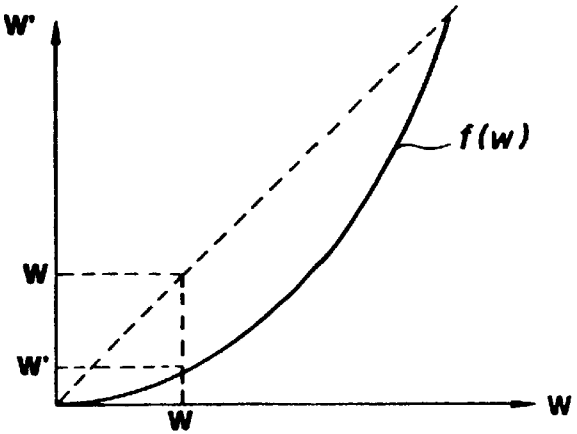

Then, the W data representing the white component value (Min (R,G,B)) is converted into W' data in accordance with the non-linear characteristic f(W) shown in FIG. 10(B). The R',B',G' data are formed by subtracting the W' data representing white component subjected to the non-linear conversion from the R,G,B color data, respectively, as expressed by equations (2).

$$\left.\begin{aligned} W' &= f(W) = 255\times\left(\frac{W}{255}\right)^{\alpha} \quad (\alpha > 1) \\ R' &= R - W' \\ G' &= G - W' \\ B' &= B - W' \end{aligned}\right] \tag{2}$$

wherein $\alpha$ is a non-linear conversion parameter, with a suitable value being approximately 2.5.

According to the process expressed by the equations (2), the amount of the white component represented by the W' data decreases, in comparison with that represented by the W data, which is not subjected to the non-linear conversion. Then, the amount of each of the R,G,B components increases in response to the decrease of the white component.

For example, in FIG. 10(B), when $\omega$ represents the white component which is not subjected to the non-linear conversion, the white component is suppressed from $\omega$ to $\omega'$ in accordance with the above non-linear conversion. The decrease of the white component ($\omega-\omega'$) is added to the R,G,B components, respectively, so as to compensate the fall in the brightness of the image to be displayed.

Figure 11:
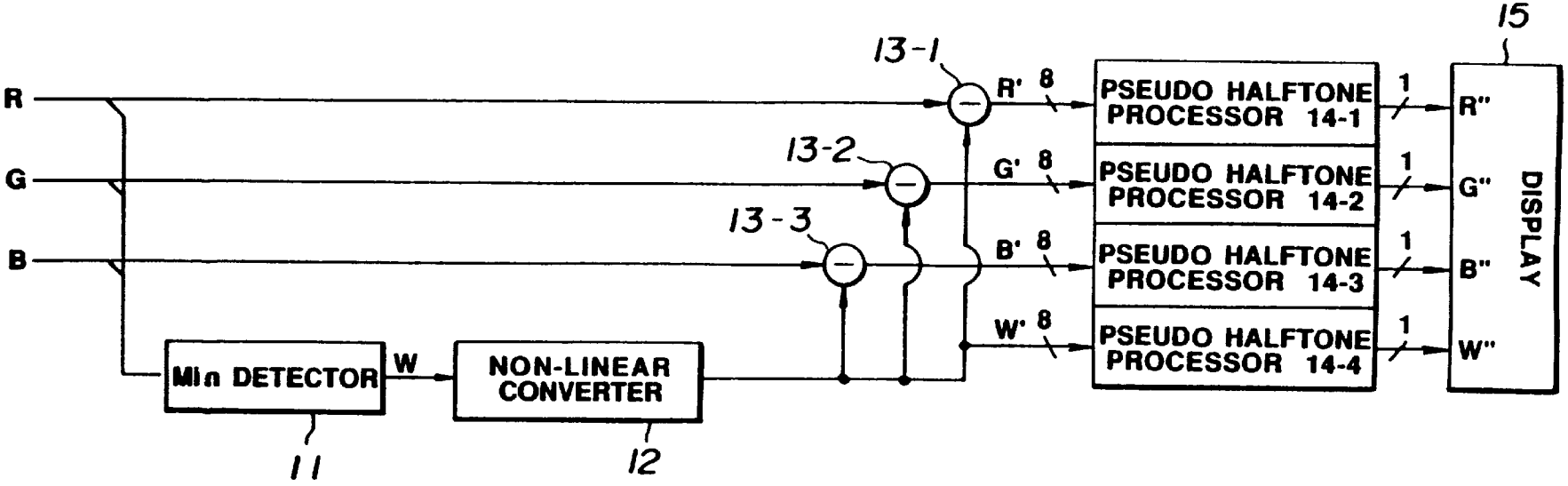
FIG. 11 is a block diagram of an image processing apparatus in accordance with a second embodiment of the present invention.

FIG. 11 shows a block diagram of an image processing apparatus having the function of suppressing the white component expressed by the equations (2).

The image processing apparatus comprises a minimum value detector 11, a non-linear converter 12, subtractors 13-1–13-3, pseudo halftone processors 14-1–14-4 and a display 15. The construction is the same as that shown in FIG. 1 except for addition of the non-linear converter 12.

The minimum value detector 11 detects a minimum value among the 8-bit R,G,B color data and outputs the detected minimum value as W data.

The non-linear converter 12 performs the non-linear conversion on the inputted W data in accordance with the non-linear characteristic f(W) shown in FIG. 10 (B). Namely, the W data is subjected to the non-linear conversion which suppresses the white component at the range where the amount of the white component is relatively low.

In this embodiment, the non-linear conversion is performed by using a look-up table stored in ROM or RAM which is included in the non-linear converter 12.

Subtractors 13-1–13-3 subtract the W' data obtained by the non-linear converter 12 from the R,G,B color data, respectively, so as to form the R',G',B' data expressed by the equations (2).

Thus, R',G',B',W' data are subjected to the pseudo halftone process by the pseudo halftone processors 14-1–14-4, respectively, to obtain binary driving data, i.e. R",G",B",W" data which drive the liquid crystal cells provided with the R,G,B,W filters. The R",G",B",W" data are supplied to the display 15.

As explained above, the white component, which is extracted from the R,G,B color data for displaying white pixels, is subjected to the non-linear conversion, which suppresses the white pixels that are displayed by using the liquid crystal cells on which the W filters are provided.

Accordingly, in the case where a color image having low brightness is displayed, the white pixels do not sparsely dot the displayed image and deterioration of the image quality can be prevented.

Moreover, a color image having high brightness is displayed by using the liquid crystal cells on which not only the R,G,B filters are but also the W filter are provided in order to display rich colors.

On the other hand, various conversion characteristics other than the non-linear characteristic shown in FIG. 10(B) may be adopted to suppress the white pixels which are displayed by the liquid crystal cells having the W filters, when the color having low brightness is displayed.

Figure 10C:
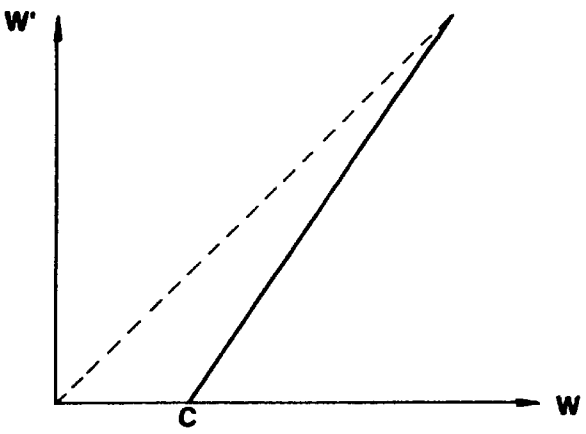

For example, a conversion characteristic shown in FIG. 10(C) may be adopted. This conversion is expressed by the following equations (3)

$$\left.\begin{aligned} W' &= 0 \quad \text{if } W \leqq C \\ W' &= \beta W \quad \text{if } W > C \quad (\beta > 1) \end{aligned}\right] \tag{3}$$

According to the conversion expressed by the equations (3), when the white component value is equal to or less than a predetermined value C, the white component value is changed into "0" so as to display the colour having low brightness without using the liquid crystal cells having the W filters.

When the white component value is more than the predetermined value C, the colour is displayed by using the liquid crystal cells having the W filters in accordance with the amount of the white component.

The predetermined value C may be set for a suitable value in consideration of the display characteristic of the liquid crystal display panel and so on.

In the image processing apparatus shown in FIG. 10, the decrease of the white component due to the non-linear conversion is added to the R,G,B components, so as to compensate for the fall in the brightness of the image to be displayed. However, it is possible that the fall in the brightness cannot be compensated by means of the above simple algorithm because the light transparent characteristics of the liquid crystal cells and the color filter thereon are not constant.

Moreover, the non-linear characteristic to obtain the W' data expressed by the equations (2) can be merely modified by changing the non-linear conversion parameter $\alpha$. Therefore, the modification of the non-linear characteristic cannot be changed freely, because it is difficult to adjust the conversion characteristic to match the characteristics of the display and the input color data.

In view of these circumstances, the W' data is obtained by the arithmetic operation dependant on the value W0 which is a minimum value among the R,G,B color data and the value W1 which is obtained by non-linear converting the minimum value W0. Namely, the W1 data is obtained by using the equations (4).

$$W0 = \mathrm{Min}(R, G, B) \tag{4}$$

$$W1 = 255 \times \left(\frac{W0}{255}\right)^{\alpha} \quad (\alpha > 1)$$

$$W' = \gamma W0 + \delta W1 \quad (\gamma, \delta > 1)$$

According to the non-linear conversion expressed by the equations (4), the non-linear conversion characteristic can approximate the optimum conversion characteristic easily and the quality of the displayed image can be improved.

Figure 12:
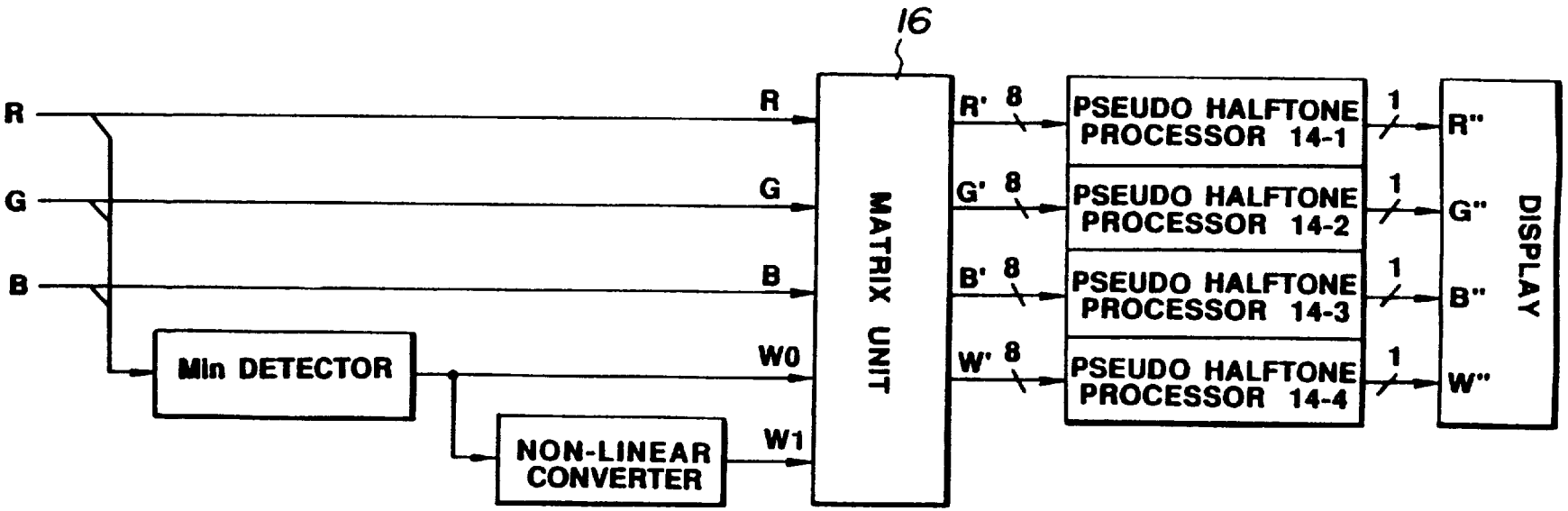
FIG. 12 is a block diagram of an image processing apparatus in accordance with a further embodiment of the present invention.

FIG. 12 shows a block diagram of another image processing apparatus having the function of suppressing the white component expressed by the equations (4).

The image processing apparatus comprises a minimum value detector 11, a non-linear converter 12, pseudo halftone processor 14-1–14-4 and a display 15, which are similar to those shown in FIG. 1 and FIG. 11.

In FIG. 12, a matrix unit 16 is provided instead of the subtractors 13-1–13-3 shown in FIG. 1 and FIG. 11.

The minimum value detector 11 detects a minimum value among the R,G,B color data and outputs the detected minimum value as WO data.

The non-linear converter 12 performs the non-linear conversion on the inputted WO data in accordance with the non-linear characteristic f(W) shown in FIG. 10 (B) and outputs the W1 data.

The WO data and W1 data are supplied to the matrix unit 16 together with the R,G,B color data.

The matrix unit 16 performs a matrix operation expressed by the equation (5) on the R,G,B color data and the WO,W1 data to obtain the R',G',B',W' data for displaying a colour image.

$$\begin{bmatrix} R' \\ G' \\ B' \\ W' \end{bmatrix} = \begin{bmatrix} a11 & a12 & a13 & a14 & a15 \\ a21 & a22 & a23 & a24 & a25 \\ a31 & a32 & a33 & a34 & a35 \\ a41 & a42 & a43 & a44 & a45 \end{bmatrix} \begin{bmatrix} R \\ G \\ B \\ W0 \\ W1 \end{bmatrix} \tag{5}$$

If "0" is substituted for the matrix parameters a41, a42, a43, and "$\gamma$" and "$\delta$" are substituted for the matrix parameters a44 and a45, respectively, the arithmetic operation expressed by the equations (4) can be carried out.

Alternatively, if the appropriate values are substituted for the matrix parameters a41, a42, a43, a44, and a45, the W' data representing the white component can be obtained in consideration with not only the white component (WO,W1) but also the R,G,B color data.

Namely, if those parameters are set in view of the characteristics in colour or brightness of the display, the color can be suitably displayed.

Moreover, by altering the values of the matrix parameters a11 through a35 which are used for obtaining the R',G',B' data, the color displayed on the basis of the R,G,B color data can be modified. Therefore, by substituting appropriate values for these fifteen parameters, the colour to be displayed on the basis of the R,G,B color data can be suitable.

The R',G',B',W' data from the matrix unit 16 are subjected to the pseudo halftone process by the pseudo halftone processors 14-1–14-4, respectively, to form binary driving data, i.e. R", G", B", W" data which drive the liquid crystal cells provided with the R,G,B,W filters. The R",G",B",W" data are supplied to the display 15.

As explained above, the white component is suppressed by using the suitable conversion characteristic, so the white pixels can be prevented from dotting an image having low brightness.

Moreover, the matrix operation can be used, so that color correction, for example, the correction of the difference between the color defined by the R,G,B color data and the colour actually displayed on the basis of the R,G,B color data can be carried out as well as suppression of white pixels. Accordingly, the color displayed can be more suitable.

Alternatively, if the matrix parameters are changeable, the color conversion or the color adjustment can be carried out by changing the matrix parameters.

In the embodiments described above, the pseudo halftone processors 14-1–14-4 are provided corresponding to the R,G,B,W colors, respectively, and the pseudo halftone process, such as an error diffusion method, is performed on each color.

Alternatively, another process, which quantities the four-dimension space defined by the R,G,B,W data, to convert it into one of the sixteen states shown in FIG. 3 and diffuses the error generated by the quantification into pixels to be processed later, may be adopted as the pseudo halftone process.

In the embodiments described above, the display is composed of liquid crystal cells each of which displays a binary image. However, a display device, which is composed of liquid crystal cells or other display elements each of which can display an image having more than two multi-levels may be used. In this case, a multi-level pseudo halftone process may be adopted as the pseudo halftone process.

Moreover, other types of display devices, such as a cathode-ray tube or a light-emitting diode display, may be used instead of the liquid crystal display disclosed in the embodiments.

Instead of the R,G,B color space signals, other colour space signals, such as YMC (yellow, magenta, cyan), L*a*b*, YIQ, may be easily adopted as color data representing a color image to be displayed.

Such color data may be supplied from an image scanner which can read a color image, a color video camera or a still video camera as well as the host computer.

It will be appreciated that the combination of pseudo halftone processors with a display may be used without white filters.

It will be appreciated that in pseudo halftone processing the "number" or "rate" of pixels corresponds to the ratio of activated pixels in a unit area, these activated pixels being transparent liquid crystal cells in the case of a ferroelectric liquid crystal display.

The present invention was explained above in reference to a few preferred embodiments, the present invention is not limited to these embodiments various modifications and changes are possible.

I claim:

1. An image processing apparatus for supplying color display data including white display data to a display means for forming a color image with a plurality of color components including a white component, comprising:

extraction means for extracting white component data from color data representing a color image;

suppressing means for suppressing the white component data so as to compensate for a decrease in the brightness of an image to be displayed; and generating means for generating color display data on the basis of the color data and the suppressed white component data, wherein said suppressing means is arranged to suppress the white component data in accordance with a non-linear characteristic depending on said display means.

2. An apparatus according to claim 1, wherein said display means is arranged to display white pixels in accordance with the color display data.

3. An apparatus according to claim 2, wherein said display means is arranged to further display red, green and blue pixels.

4. An apparatus according to claim 1, wherein said display means has a liquid crystal display panel composed of a plurality of liquid crystal cells.

5. An apparatus according to claim 4, wherein said liquid crystal display panel is composed of ferroelectric liquid crystals.

6. An apparatus according to claim 1, wherein said extraction means is arranged to extract a minimum value among the color data as the white component data.

7. An apparatus according to claim 6, wherein said extraction means is arranged to extract a minimum value among red, green and blue data included in the color data.

8. An apparatus according to claim 1, wherein said generating means is arranged to generate the color display data by removing the suppressed white component data from the color data.

9. An apparatus according to claim 8, wherein said generating means is arranged to subtract the suppressed white component data from red, green and blue data included in the color data.

10. A display apparatus including an image processing apparatus according to claim 9 and a display means.

11. An image processing method comprising the steps of:

supplying color display data including white display data to a display means for forming a color image with a plurality of color components including a white component, the method being characterized by the steps of:

extracting white component data from color data representing a color image;

suppressing the white component data so as to compensate for a decrease in the brightness of an image to be displayed;

generating color display data on the basis of the color data and the suppressed white component data; and displaying a color image in accordance with the color display data, wherein the image is displayed by using red, green blue and white pixels, and wherein the white component is suppressed in accordance with a non-linear characteristic depending on said display means.

12. A method according to claim 11, wherein the color image is displayed by a liquid crystal display panel which is composed of a plurality of liquid crystal cells.

13. A method according to claim 12, wherein the liquid crystal display panel is composed of ferroelectric liquid crystals.

14. A method according to claim 11, wherein a minimum value among the color data is extracted as the white component data.

15. A method according to claim 14, wherein the minimum value among red, green and blue data included in the color data is extracted as the white component data.

16. A method according to claim 11, wherein the color display data are generated by removing the suppressed white component data from the color data.

17. A method according to claim 11, wherein the color display data are generated by subtracting the suppressed white component data from red, green and blue data included in the color data.

* * * * *

UNITED STATES PATENT AND TRADEMARK OFFICE

CERTIFICATE OF CORRECTION

PATENT NO. : 5,929,843

DATED : July 27, 1999

INVENTOR(S) : HIROSHI TANIOKA

It is certified that error appears in the above-identified patent and that said Letters Patent is hereby corrected as shown below:

Title page,

AT [56] REFERENCES CITED

FOREIGN PATENT DOCUMENTS

Insert --0378780 7/1990 European Pat. Off. G09G 3/20--.

AT [56] REFERENCES CITED

OTHER PUBLICATIONS

Insert --IBM Technical Disclosure Bulletin, Vol. 28, No. 1, June 1985, "Digital Color Halftone Reproduction"--.

IN THE DRAWINGS

FIG. 12, Sheet 10, label the box "Min DETECTOR" as --11--; label the box "NON-LINEAR CONVERTER" as --12--; and label the box "DISPLAY" as --15--.

UNITED STATES PATENT AND TRADEMARK OFFICE

CERTIFICATE OF CORRECTION

PATENT NO. : 5,929,843

DATED : July 27, 1999

INVENTOR(S) : HIROSHI TANIOKA

It is certified that error appears in the above-identified patent and that said Letters Patent is hereby corrected as shown below:

COLUMN 1

Line 12, close up right margin;
Line 13, close up left margin; and
"are as" should read --are used as--;
Line 25, "oriented stably" should read --stably oriented--;
Line 27, "oriented stably" should read --stably oriented--;
Line 45, ", of" should read --in--;
Line 49, "the" should be deleted; and
Line 64, "colour" (both instances) should be deleted. and should read --color--.

COLUMN 2

Line 28, "and other" should read -- and other aspects--;
Line 37, "illustrates" should read --illustrates a portion--;
Line 38, "to" should be deleted;
Line 41, "is a drawing to" should be deleted;
Line 45, "is a drawing to" should be deleted;
Line 48, "is a drawing to" should be deleted;
Line 50, "is a drawing to" should be deleted; and
Line 54, "B'and ," should read --B' and--.

UNITED STATES PATENT AND TRADEMARK OFFICE

CERTIFICATE OF CORRECTION

PATENT NO. : 5,929,843

DATED : July 27, 1999

INVENTOR(S) : HIROSHI TANIOKA

It is certified that error appears in the above-identified patent and that said Letters Patent is hereby corrected as shown below:

COLUMN 3

Line 9, "single basic" should read --basic--; and "pixel" should read --single pixel--;
Line 28, "However" should read -- However,--;
Line 29, "neighbouring" should read --neighboring--;
Line 38, "pixel by pixel" should read --, pixel by pixel,--;
Line 48, "data" should read --data,--;
Line 49, "the," (1st occurrence) should read --the--; and
Line 65, "be" should be deleted.

COLUMN 4

Line 16, "In FIG. 5" should read --In FIG. 5,--;
Line 21, "to" should read --by--;
Line 38, "binarised" should read --binarized--; and
Line 42, "binarising" should read --binarizing--.

COLUMN 5

Line 24, "green and," should read --green, and--;
Line 28, "where," should read --, where--; and "of" should be deleted;
Line 62, "preferred one" should read --preferred. One--; and
Line 63, "crystal" should read --crystal,--.

UNITED STATES PATENT AND TRADEMARK OFFICE

CERTIFICATE OF CORRECTION

PATENT NO. : 5,929,843

DATED : July 27, 1999

INVENTOR(S) : HIROSHI TANIOKA

It is certified that error appears in the above-identified patent and that said Letters Patent is hereby corrected as shown below:

COLUMN 6

Line 9, "oxide)," should read --oxide)--;
Line 11, "substrates" should read --substrates,--;
Line 26, "polarisers" should read --polarizers--;
Line 50, "fast secondly," should read --fast. Secondly,--;
Line 62, "colour" should read --color--; and
Line 67, "colours" should read --colors--.

COLUMN 7

Line 16, "low brightness" should read --low-brightness--;
Line 19, "such colors is performed, is displayed" should be deleted;
Line 20, "colour" should read --colors--;
Line 21, "with" should be deleted;
Line 26, "when," (1st occurrence) should be deleted; and "the color of" should be deleted; and
Line 29, "the colour of" should be deleted; and "high brightness" should read --high-brightness--.

COLUMN 8

Line 47, "the" should be deleted; (2nd occurrence)
Line 50, "not only the" should be deleted; and
Line 51, "filters are but also the W filter" should read --and W filters--.

UNITED STATES PATENT AND TRADEMARK OFFICE

CERTIFICATE OF CORRECTION

PATENT NO. : 5,929,843

DATED : July 27, 1999

INVENTOR(S) : HIROSHI TANIOKA

It is certified that error appears in the above-identified patent and that said Letters Patent is hereby corrected as shown below:

COLUMN 9

Line 2, "colour" should read --color--;
Line 32, "W1" should read --W'--; and
Line 66, "colour" should read --color--.

COLUMN 10

Line 18, "colour" should read --color--;
Line 36, "used," should read --used--;
Line 39, "colour" should read --color--;
Line 40, "data" should read --data,--; and
Line 51, "quantities" should read --quantifies--.

COLUMN 11

Line 1, "colour" should read --color--;
Line 17, "the" should read --but the--;
Line 18, "embodiments various" should read --embodiments. Various--.

UNITED STATES PATENT AND TRADEMARK OFFICE

CERTIFICATE OF CORRECTION

PATENT NO. : 5,929,843

DATED : July 27, 1999

INVENTOR(S) : HIROSHI TANIOKA

It is certified that error appears in the above-identified patent and that said Letters Patent is hereby corrected as shown below:

COLUMN 12

Line 27, "green blue" should read --green, blue--.

Signed and Sealed this

Twenty-second Day of August, 2000

*Attest:*

Q. TODD DICKINSON

*Attesting Officer*

*Director of Patents and Trademarks*